US005343230A

United States Patent [19]

Dietl

[11] Patent Number: 5,343,230

[45] Date of Patent: Aug. 30, 1994

[54] ELECTRICAL INTERCONNECT ACTUATION WHICH INTERACTS WITH CAP STATION ARTICULATION

[75] Inventor: Steven J. Dietl, Ontario, N.Y.

[73] Assignee: Xerox Corporation, Stamford, Conn.

[21] Appl. No.: 979,034

[22] Filed: Nov. 20, 1992

[51] Int. Cl.[5] ..... B41J 2/165

[52] U.S. Cl. ..... 347/31; 347/32

[58] Field of Search ..... 346/1.1, 140 R

[56] References Cited

U.S. PATENT DOCUMENTS 4,401,990 8/1983 Aiba et al. ..... 346/140 R 4,533,927 8/1985 Iwagami et al. ..... 346/140 R

*Primary Examiner*—Benjamin R. Fuller

*Assistant Examiner*—Valerie Ann Lund

*Attorney, Agent, or Firm*—Oliff & Berridge

[57] ABSTRACT

An ink jet printer having cap station articulation with a printhead cartridge located on a fast scan carriage. The fast scan carriage includes a sliding connector plate which allows easy vertical insertion and electrical interconnect of the printhead cartridge without interference of the capping station. Movement of the sliding connector plate can be controlled manually, or automatically, by a latch to provide for cartridge installation. When the latch is closed, the latch fixedly attaches the sliding connector plate on the fast scan carriage. When the latch is opened, the sliding connector plate is movable to a cartridge install position spaced a distance along the scan carriage and displaced from a cap station. In this position, the cartridge is free to be dropped vertically onto the sliding connector plate, using features provided by a heat sink and a plastic cartridge wall as rough locators.

18 Claims, 6 Drawing Sheets

ELECTRICAL INTERCONNECT ACTUATION WHICH INTERACTS WITH CAP STATION ARTICULATION

BACKGROUND OF THE INVENTION

1. Field of the Invention

This invention relates to a thermal ink jet printer having an electrical interconnect actuation which interacts with cap station articulation. More specifically, the invention relates to a sliding connector plate located on a fast scan carriage of a printer which allows easy vertical insertion and electrical interconnect of a printhead cartridge without interference of a capping station.

2. Description of Related Art

In most conventional, commercially available thermal ink jet printers, a printhead comprising a plurality of nozzles located on a channel plate is associated with a reservoir of ink. A heater plate is associated with the channel plate and includes a plurality of resistors which receive signals providing current to the resistors to selectively heat one or more of the resistors. The heated resistors, in turn, heat ink located in an associated nozzle of the channel plate and form a droplet of ink which is expelled from the nozzle onto a print medium, such as a sheet of paper.

The printhead is usually located within a printhead cartridge which houses the printhead, comprising the channel plate and heater plate and associated nozzles and resistors, and also the ink reservoir. The print cartridge is supported in a carriage which is movable along a path perpendicular to the direction of movement of the print medium through the printer. The exact control of the movement of the printhead on the carriage is controlled by a microprocessor which operates a drive motor and a belt drive.

Maintenance stations are often provided on thermal ink jet printers to maintain and service the printhead. These can include capping stations for capping printhead nozzles during non-use to prevent contaminants from entering the nozzles and to prevent drying of the ink within the nozzles which can cause clogging. These maintenance stations may also include purge stations and wiping stations.

In such systems, ink jet cartridges are usually installed at a home position of the carriage, which is at an end of the path of travel of the carriage, beyond the normal path of the carriage traversed during printing. The maintenance stations are also located near the home position and the cartridge printhead is capped by the maintenance station during periods of non use.

One particular scanning head thermal ink jet printer design has the printhead nozzles oriented 45° off of horizontal (firing 45° down). In this type of printer, it is necessary to install the printhead cartridge at 45° so that a cartridge capping surface on a front face of the printhead cartridge contacts a cap station seal in a direction normal to the seal. This is required to avoid problems with sliding die channels of the nozzles of the printhead across the seal. Without 45° insertion, the cap station becomes an interference to cartridge insertion and has several problems relating to ergonomics of the insertion and to prohibitive cost increases in the cartridge. It is highly desirable to have vertical cartridge insertion for such a printer.

SUMMARY OF THE INVENTION

It is an object of the invention to provide a thermal ink jet printer having a replaceable cartridge and a maintenance station which is capable of easy vertical cartridge insertion without interference of the maintenance station.

It is a further object of the invention to provide a slidable connector plate which can slidably engage and disengage with a fixed datum plate to fixedly retain a printhead cartridge on a scan carriage when engaged with the datum plate and to provide a cartridge installation position displaced from the datum plate when the sliding connector plate is disengaged.

It is a further object of the invention to provide a mechanism which interrupts the power connection between a power supply of the printer and the printhead during insertion of the printhead cartridge.

It is a further object of the present invention to provide an apparatus and method of cap station articulation which eliminates relative sliding movement with a printhead and is actuated by fast scan carriage movement.

A thermal ink jet printer has been devised to overcome the above and other problems with prior printhead cartridge installations and printer cap station articulation. The present invention provides a thermal ink jet printer in which a cap station is articulated by the fast scan carriage motion of the printer using one or more cam ramp mechanisms. This approach allows already existent carriage motion (required for printer) to force a cap seal of the cap station into a sealing position without any sliding motion relative to the front face of the printhead containing the printhead nozzles. The cap seal compression is the only source of spring force between the cap seal and the printhead.

During normal operation, a tang on the cap station extends into the longitudinal path of movement of the scan carriage and contacts the scan carriage when the carriage returns to the home position. This moves the cap station from an inoperative capping position, which also serves as a cartridge install position, to a cap sealing position. A feature which contacts the cap station tang is located on a sliding connector plate located on the fast scan carriage. This plate can slide in a direction parallel with the longitudinal direction of movement of the fast scan carriage. When the carriage containing the sliding connector plate leaves the home position, travelling back to the printing position, the tang is not constrained by the sliding connector plate, and as such, does not respond to travel in this direction by the sliding connector plate. However, forces such as a biased spring force allow the cap station to return to the inoperative capping position.

Additionally, the cap station articulation is controlled manually, or automatically, by a latch mechanism to provide for cartridge installation. When the latch is opened, away from the datum plate, the sliding connector plate is released from the fixed datum plate and the sliding connector plate is moved a distance longitudinally along the carriage path by suitable moving means such as a cam. Opening of the latch, and the longitudinal movement of the sliding connector plate associated therewith, also allows the cap station to be biased to the cartridge install position, i.e., spaced a distance normal to the sliding connector plate and laterally a distance toward a printing area of the carriage. In this position, the cartridge is free to be dropped vertically onto the connector plate, using features provided by a heat sink and a plastic cartridge wall as rough locators.

When the latch is closed, the latch cam pushes the sliding connector plate, which includes a heat sink, longitudinally against the fixed datum plate. The feature of the sliding connector plate of the fast scan carriage once again contacts the cap station tang and pushes the cap seal up the ramp mechanism to make contact with the front face of the printhead cartridge (cap sealing position).

The drawings illustrate one embodiment of the invention and explain its principles of operations.

DESCRIPTION OF PREFERRED EMBODIMENTS

Figure 1:
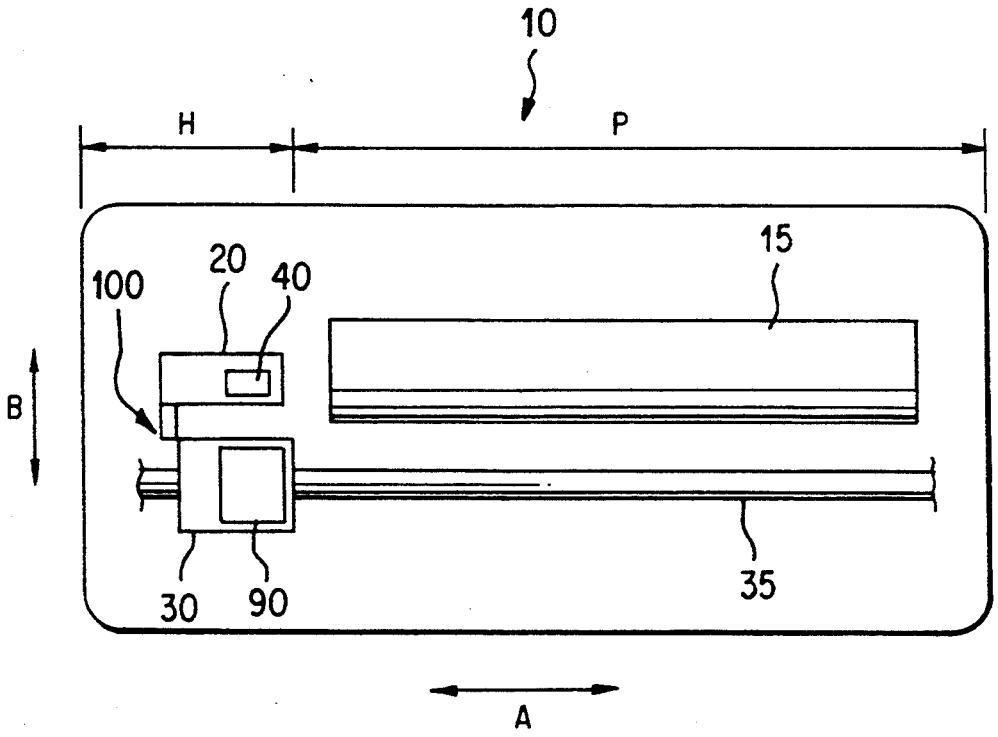
FIG. 1 is a top view of an ink jet printing system according to the present invention.
Figure 2:
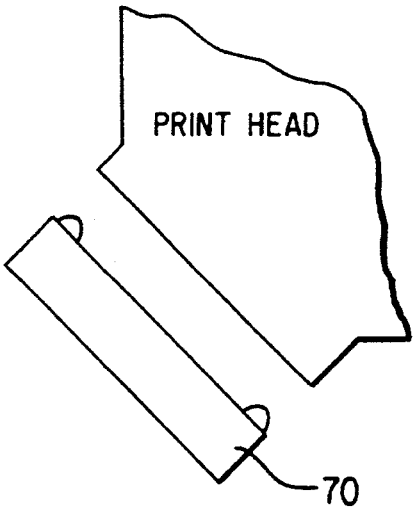
FIG. 2 is a representation of a cap seal of a maintenance station in an inoperative position.
Figure 3:
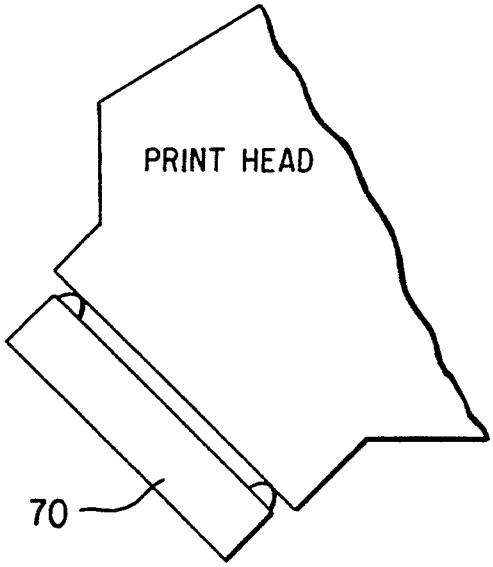
FIG. 3 is a representation of the cap seal of FIG. 2 in an operative cap sealing position in contact with a front nozzle face of a printhead cartridge.

With reference to FIG. 1, a thermal ink jet printer 10 embodying the present invention is shown. The thermal ink jet printer 10 has a maintenance station 20 located in a home area H laterally displaced from a printing area P of the printer 10. The printing area P includes a roller 15 on which paper is fed to position the paper for printing. A fast scan carriage 30 traverses in a longitudinal direction between the home and printing areas on one or more scan rails 35 and carries a printhead cartridge 90. The maintenance station 20 includes a cap station 40 articulated by the fast scan carriage motion of the printer 10 using a ramp mechanism. As shown, a feature 100 of the cap station 40 extends into the path of fast scan carriage 30 and allows movement of the cap station 40 to be articulated by fast scan carriage movement. As shown in FIGS. 2–3, this approach allows already existent carriage motion (required for printer) to force a cap seal 70 of the cap station 40 into a sealing position in direct contact with a front printhead nozzle face 80 (having 45° nozzle orientation) of a printhead cartridge 90 (partially shown) of the printer without any sliding motion relative to the front face 80. The cap seal compression is the only source of spring force between the cap seal 70 and the printhead.

Figure 4:
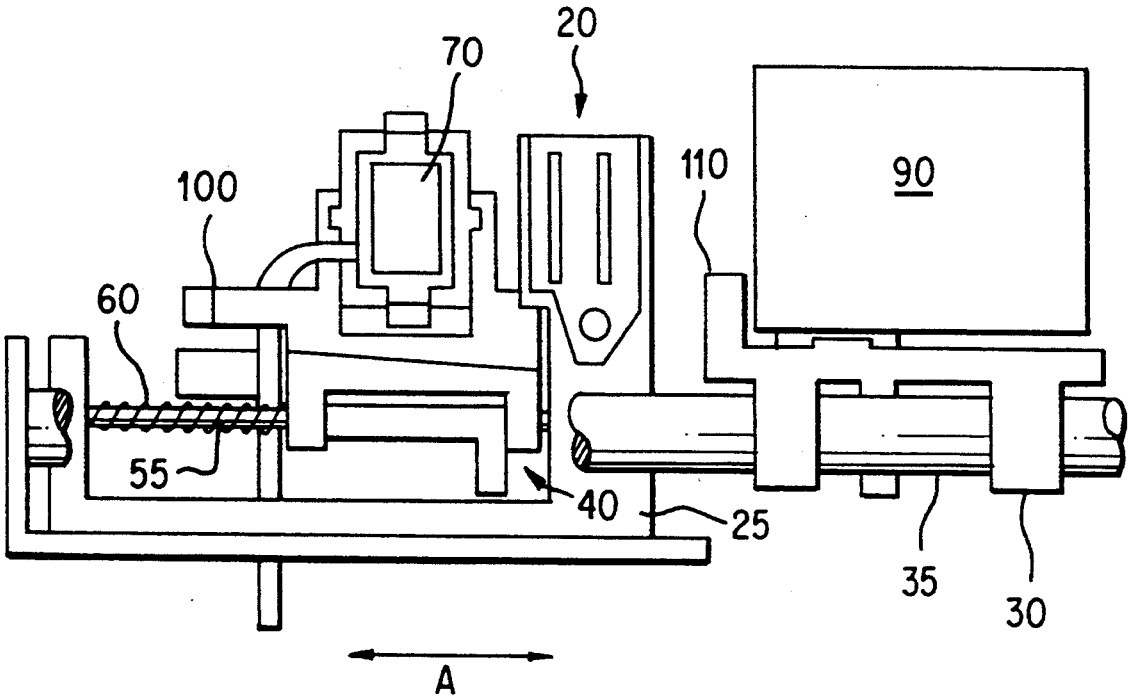
FIG. 4 is a side view of a maintenance station of a thermal ink jet printer in an inoperative capping position.
Figure 5:
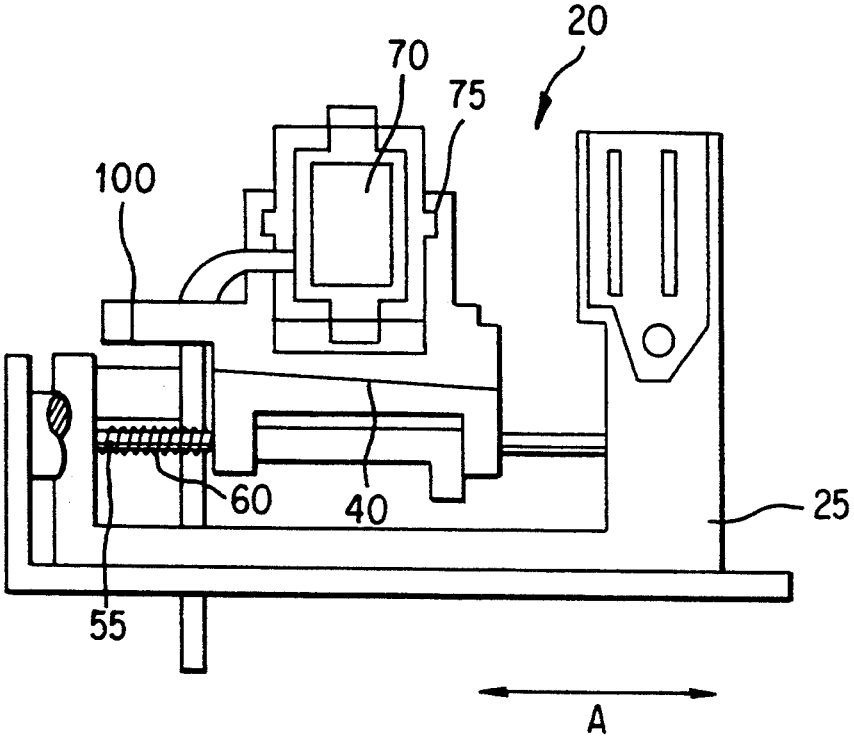
FIG. 5 is a side view of the maintenance station of FIG. 4 in a cap sealing position.
Figure 6:
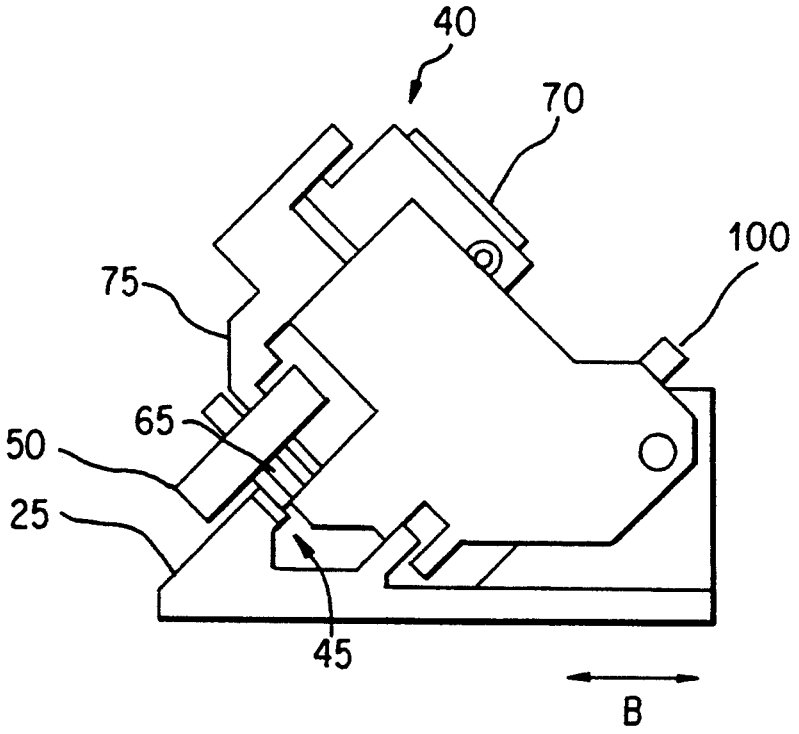
FIG. 6 is an end view of a maintenance station of FIG. 4 in an inoperative capping position.
Figure 7:
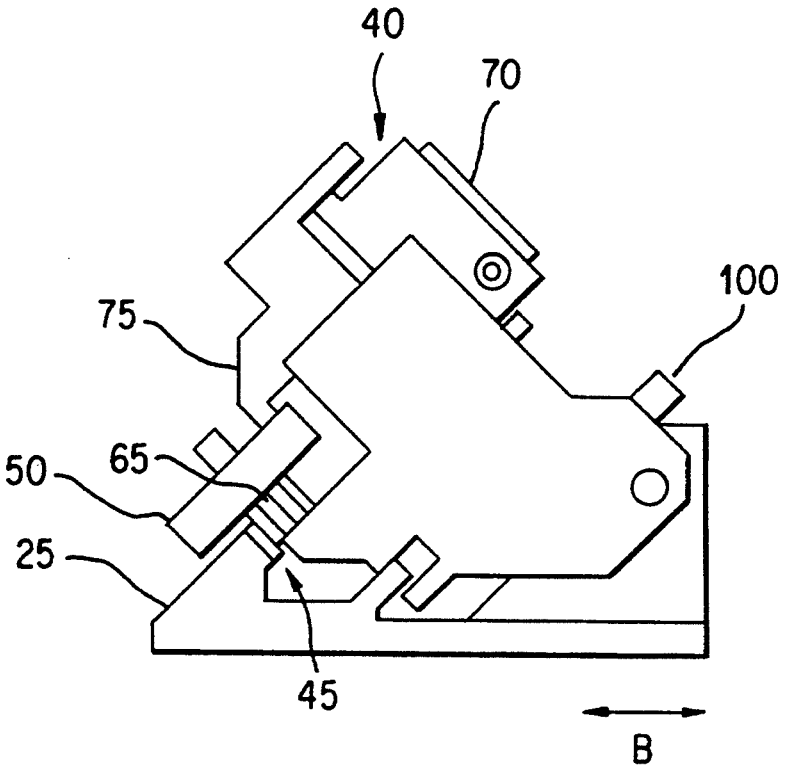
FIG. 7 is an end view of the maintenance station of FIG. 4 in a cap sealing position.

As better shown in FIGS. 4–7, the cap station 40 is movable between an inoperative capping position (FIGS. 4 and 6) and a cap sealing position (FIGS. 5 and 7). Preferably, the capping station 40 is biased to the inoperative capping position. This can be achieved in several ways. As shown, cap station 40 is articulated for longitudinal movement parallel to the direction of fast scan carriage motion by being movably mounted on shaft 55. The capping station 40 may be biased by a spring 60 located around shaft 55 which urges the capping station 40 to the inoperative capping position (FIG. 4). Other suitable means for biasing the cap station are contemplated.

During normal operation, a feature 100 on the cap station 40 contacts a feature 110 on a portion of the scanning carriage 30 when the carriage returns to the home position H. This can be seen in FIG. 11 from a top view and also can be seen in FIG. 5 if the scan carriage 30 is envisioned to continue to travel longitudinally in direction A. Actual contact of feature 100 with feature 110 is not shown in FIG. 5 to clarify the elements of cap station 40. The feature 100 on the cap station 40 is preferably a tang located for longitudinal movement parallel with movement of the fast scan carriage 30. The tang 100 is substantially perpendicular to the fast scan carriage 30 and extends toward the fast scan carriage 30 a distance sufficient to engage feature 110 which is located on a sliding connector plate 120 (FIGS. 8–11) slidably attached to the fast scan carriage 30.

Initially, when in the inoperative capping position (FIGS. 4 and 6), i.e., during printing, the capping station 40 is spaced a distance in the longitudinal direction (Arrow A) and inwardly offset a distance normal to the longitudinal direction (Arrow B) from the capping position (FIG. 7). The inoperative position may also be vertically offset from the cap sealing position. Upon contact of tang 100 with feature 110, the cap station 40 is laterally displaced a small distance and outwardly extended into contact with the front face 80 of printhead cartridge 90 (FIG. 3) such that there is no relative sliding contact between the front face 80 and cap seal 70 of cap station 40, which may cause frictional damage to the front face 80. Once forced to the cap sealing position (FIGS. 3, 5 and 7) by tang 100 of scan carriage 30, the cap station 40 will remain in the cap sealing position until either a printing operation is initiated or when printhead cartridge 90 is to be removed or inserted. The fast scan carriage and the printhead cartridge are purposely eliminated from the representation of FIG. 5 to better clarify the movement of maintenance station 20 which would otherwise be blocked from view.

As best shown in FIGS. 6 and 7, the maintenance station 20 includes a frame 25 on which the cap station 40 articulates. The cap station 40 as well as being longitudinally movable along shaft 55, is movable toward the front face 80 of printhead cartridge 90. In a preferred embodiment, the frame 25 is provided with a longitudinally extended row of teeth 45 upon which a cam 50 having mating teeth 65 can move therealong. A portion 75 of the cap station 40 containing cap seal 70 is connectedly attached to the cam 50 within an oblong groove (not shown) on a surface of the cam 50. Rotation of the cam 50 along the row of teeth 45 guides the portion 75, and in turn cap seal 70, toward and away from the front face 80. Thus, in the inoperative position (FIG. 6), cap seal 70 is retracted. Movement of the cap station 40 to the cap sealing position along shaft 55 also rotates cam 50 longitudinally along the row of teeth 45, thus projecting the cap seal 70 toward the front face 80 due to the oblong section of cam 50.

The fast scan carriage 30 includes a fixed datum feature plate 130 (FIGS. 9–11) which is fixedly attached near an end of the fast scan carriage 30. The fixed datum plate 130 provides accurate positioning features for aligning the printhead cartridge 90 and a sliding connector plate 120 to the carriage 30. The fixed datum plate 130 includes multiple datum features 140 and 150 which mate with corresponding datum features 160 and 170 (FIG. 12) located on a heat sink 180 affixed to sliding connector plate 120.

Figure 8:
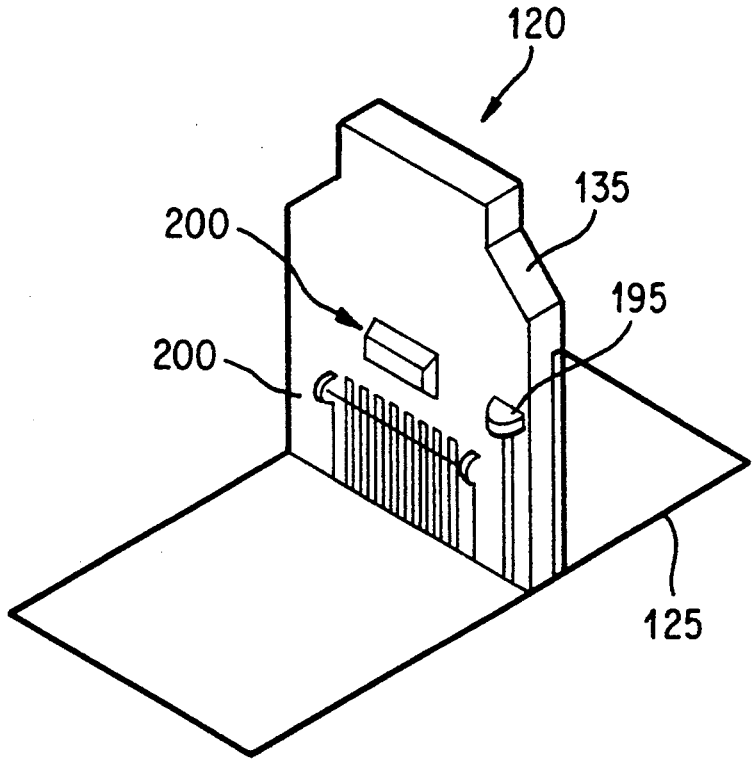
FIG. 8 is an isometric view of a sliding connector plate according to the present invention.
Figure 9:
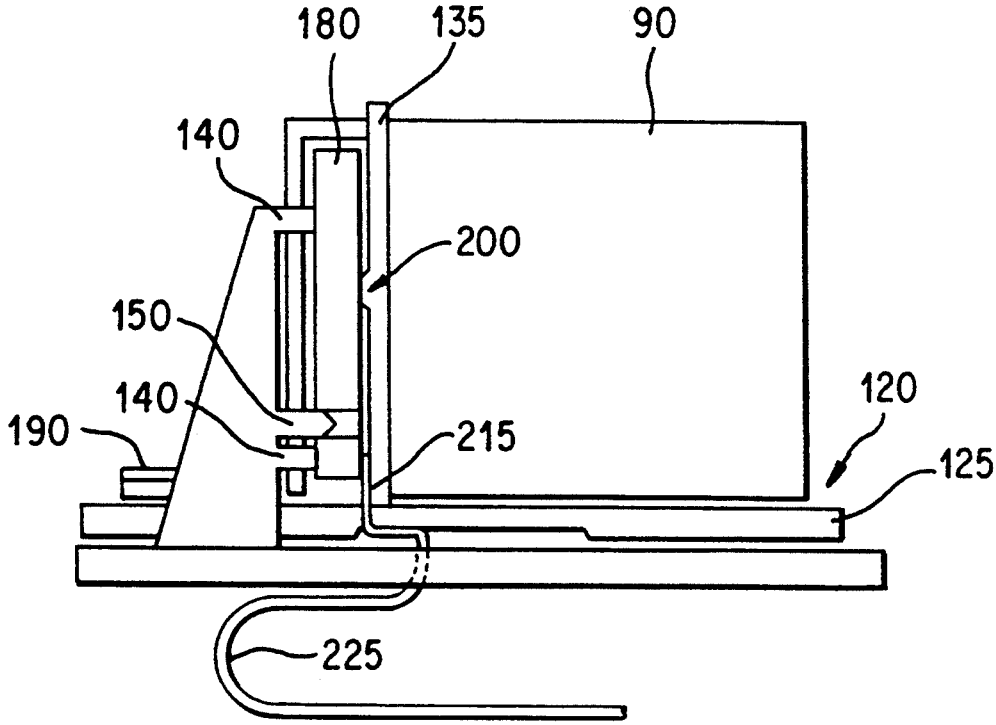
FIG. 9 is a side view of cartridge installation and actuation components according to a preferred embodiment of the present invention in a cap sealing position.
Figure 10:
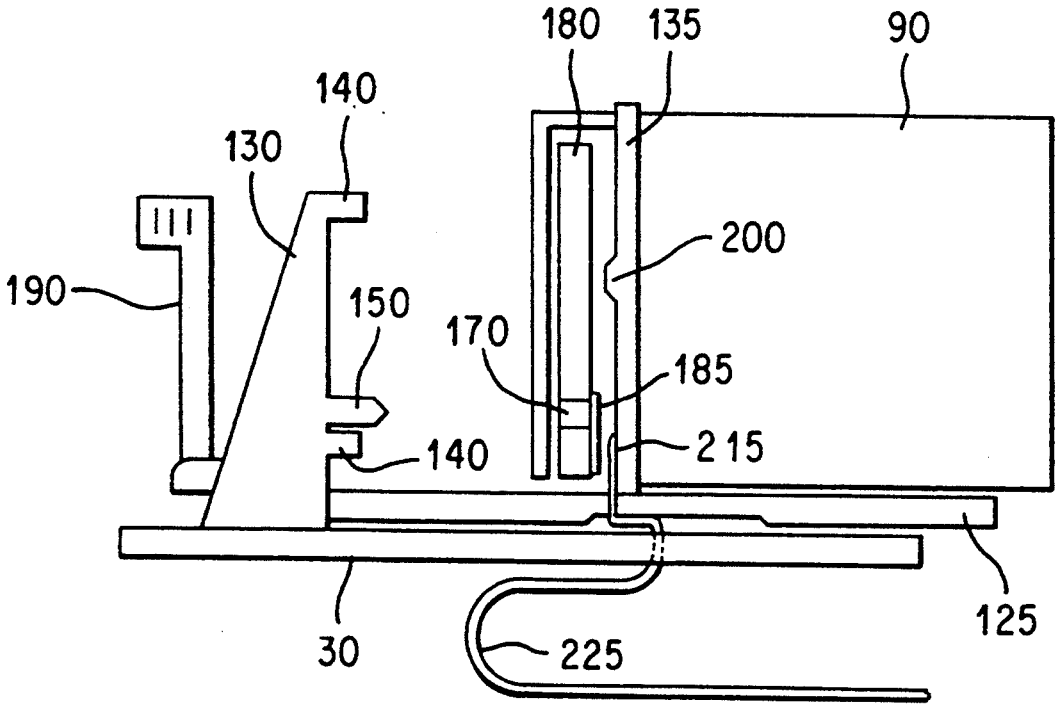
FIG. 10 is a side view of cartridge installation and actuation components according to a preferred embodiment of the present invention in a cartridge install position.
Figure 11:
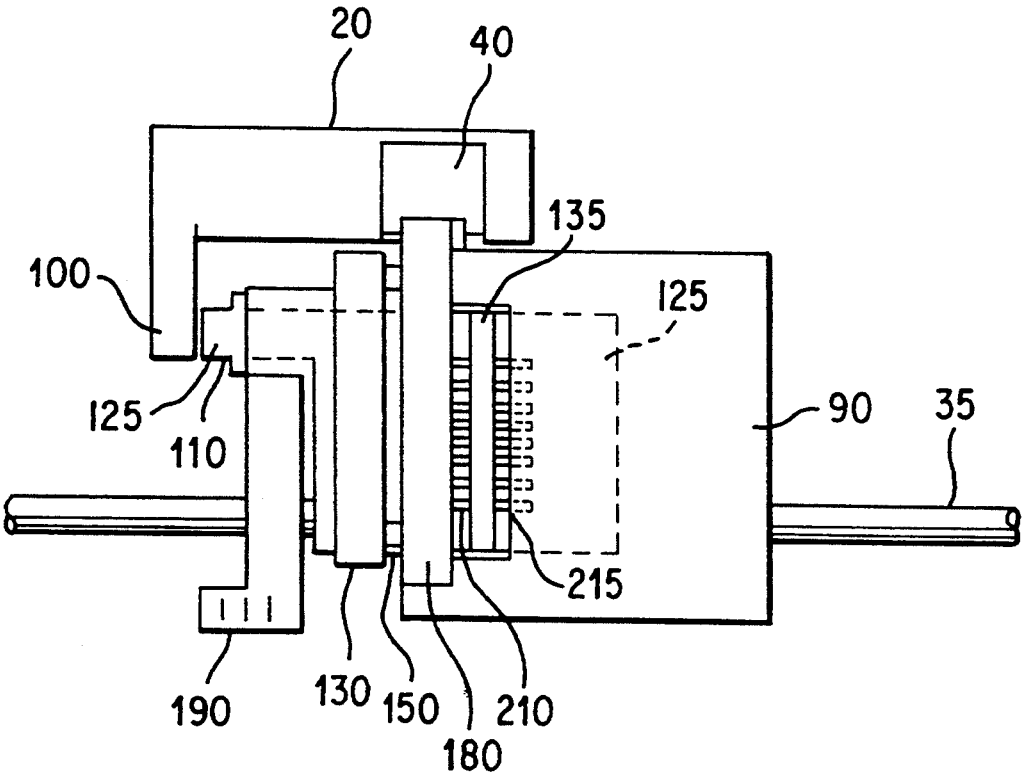
FIG. 11 is an enlarged top view of the fast scan carriage and maintenance station.

A preferred design of sliding connector plate 120 is shown in FIG. 8. The sliding connector plate 120 includes a horizontal sliding portion 125 and a vertical supporting portion 135. The vertical supporting portion is located between the cartridge 90 and the heatsink 180 and must mechanically and electrically connect these components to each other and to the printer 10 itself (FIGS. 9 and 10). A side of the vertical supporting portion 135 facing the fixed datum plate 130 and the heatsink 180 is provided with a standoff 200 and a PWB (printed wire board) cartridge lead connector 210 having contacts 215. The PWB connector 210 connects leads from a PWB 185, located on a backside of heatsink 180 adjacent vertical portion 135 (as better shown in FIG. 12), to the underside of the sliding connector plate 120 and ultimately to a ribbon cable 225, which electrically connects the cartridge 90 to a power supply and intermediate circuits of the printer 10. The PWB connector 210 includes a ground 195. The cable 225 is preferably hardwired to contacts 215 on the underside of sliding connector plate 120.

The printer 10 is provided with a latch mechanism 190 which, when closed, maintains the sliding connector plate 120, and components thereon such as heatsink 180, fixedly attached to fast scan carriage 30 (FIG. 9). When the fast scan carriage 30 traverses from the printing area P into home area H, the sliding connector plate 120 (and in particular feature 110) pushes the cap station 40 up the cam 50 to make contact with the front face 80 of the printhead cartridge 90. During non-printing periods, the cartridge 90 is maintained against the fixed datum feature plate 130 and the cap seal 70 of cap station 40 maintains direct contact with front face 80 of cartridge 90 to seal the printhead.

When printing is required, the fast scan carriage 30 traverses the printer 10 and the sliding connector plate 120 remains fixedly attached to the fast scan carriage 30. When the carriage 30 containing the sliding connector plate 120 leaves the home area H, travelling back to the printing area P, the tang 100 of capping station 40 is not constrained by feature 110 of sliding connector plate 120, and as such, is biased back to the inoperative capping position.

To facilitate insertion or removal of cartridge 90, the latch 190 is opened. This is done while the carriage 30 is in the home area H. When latch 190 is opened, the sliding connector plate 120 is slidably moved a short distance in the longitudinal direction (toward the printing area) relative to the fast scan carriage 30 (from that of FIG. 9 to that of FIG. 10). This movement, which may be on the order of 10mm, releases the sliding connector plate 120 from intimate contact with fixed datum plate 130. Preferably, the distance between the cap station 40 in the inoperative and cap sealing positions (along the longitudinal direction) is substantially equal to or less than the distance traveled by sliding connector plate 120 when opened. This allows full movement of the capping station 40 between the operative and non-operative positions. Upon movement of feature 110 on sliding plate 120, due to the opening of latch 190, the cap station 40 is no longer restrained in the cap sealing position and is allowed to slide to a cartridge install position, which is the same as the inoperative cap sealing position. In this position, because of the profile and structure of cam 50, the cap station 40 is spaced a distance normal to the longitudinal direction such that vertical insertion or removal of cartridge 90 can be facilitated. When the sliding connector plate 120 moves from the position shown in FIG. 9 to the position shown in FIG. 10, the cap station 40 is also moved in the longitudinal direction (and normal thereto away from the front face 80) to eliminate any relative sliding contact which may damage the front face 80 due to frictional forces between the front face 80 and cap seal 70. The cartridge 90 is now free to be dropped onto the connector plate 120, since it is displaced from the cap station 40, using features provided by the heat sink 180 and a plastic cartridge wall as rough locators. This particular arrangement is especially important when the cartridge 90 utilizes a 45° angled printhead which requires an angled cap seal 70. Without the cap station 40 moving to the cartridge install position, the angled cap seal 70 would constrict direct vertical removal of the cartridge 90. However, this type of cap station movement is also advantageous to cartridges having normal printheads since it spaces the cap station 40 away from the cartridge during insertion or removal such that sliding frictional contact between the front face 80 and cap seal 70 does not occur.

The standoff 200 on sliding connector plate 120, and in particular on vertical portion 135 of sliding connector plate 120, serves as a stop point which limits the amount of deflection that connector 210 occurs when the heatsink 180 is compressed against the vertical portion 135 when the latch 190 is closed. The size and location of the standoff 200 controls the deflection of connector 210 on leads of PWB 185. This is highly desirable since fine pitch contacts of the connector 210 have little latitude between necessary contact force (>100 grams per contact) and exceeding yield strain. The standoff 200 is positioned strategically so that adequate force is applied between the heat sink and the fixed datum features even during carriage acceleration and deceleration. This is highly desirable to avoid motion quality defects as well as fretting corrosion in the electrical connection of the PWB board 185 and connector 210. A preferred location of standoff 200 is substantially midway up vertical portion 135 of sliding connector plate 120. Additionally, the standoff 200 extends outward from vertical portion 135 a distance which is slightly less than the outermost extension of connector 210. This allows contacts 215 of connector 210 to compress slightly and apply the necessary contact force onto the PWD leads to electrically interconnect the PWB 185 to connector 210 which is connected to a power supply of printer 10 through cable 225. The exact distance depends on the desired amount of force required, the spring deflection rate of contacts 215 of connector 210 and other constraints.

Figure 12:
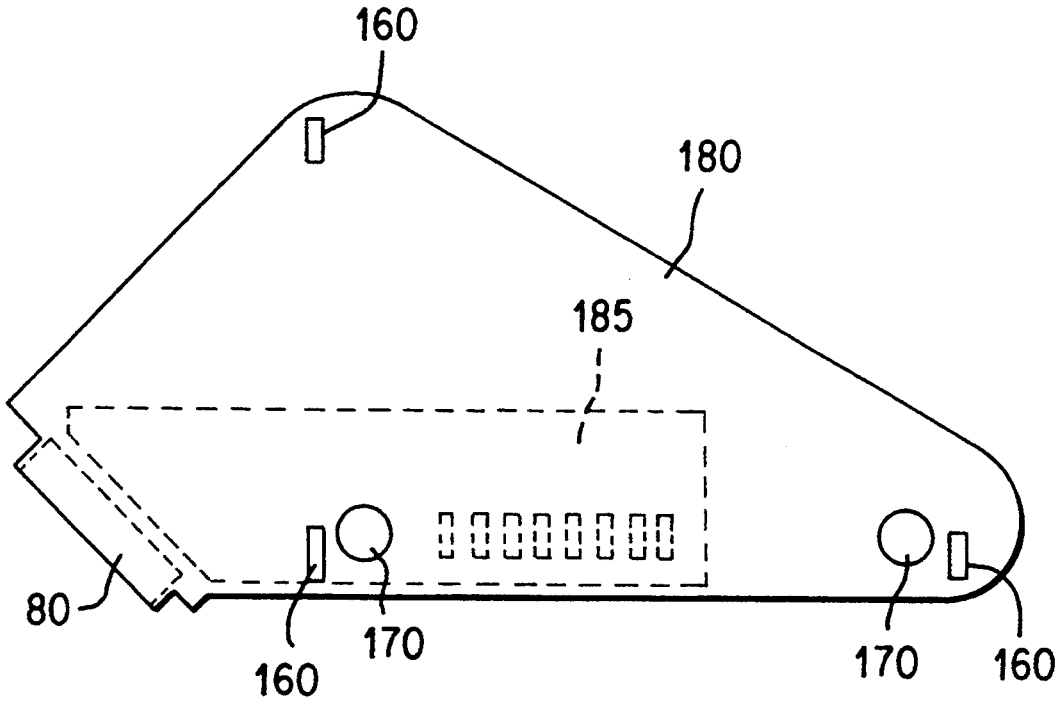
FIG. 12 is a side view of heat sink datum features according to a preferred embodiment of the present invention.

The present invention enables "drop in" vertical ink jet printhead cartridge insertion in a 45° nozzle orientation printer. However, by providing sliding connector plate 120, the cartridge 90 needs to be accurately retained on the carriage 30. The datum features 140, 150, 160 and 170 (as shown in FIGS. 9–10 and 12) are provided to align the sliding connector plate 120 with the fixed datum plate 130. As better shown in FIG. 6, heat sink 180 has three spaced Pin to Slot datum features 160 and two spaced Pin to Hole datum features 170. Features 160 and 170 precisely align the heat sink 180 and carriage 30 with datum plate 130. The position and number of datum features may be modified to accommodate sizes or shapes of heat sinks and datum plates.

Another feature of the present invention is the ability to break power connections with the cartridge during installation or removal. This can be accomplished two ways. First, power interruption may be provided by the specific structural relationship between the heatsink 180, PWB 185 and contacts 215 of connector 210 in the opened and closed latch positions. As shown in FIG. 5B, the heatsink 180 may naturally be spaced slightly away from standoff 200 and contacts 215. This provides interruption of power to the cartridge during installation when the latch 190 is opened and the sliding connector plate 120 is moved. Upon closing latch 190, the power is reconnected by forcing the vertical portion 135 of sliding connector plate 120 against the fixed datum surface, wedging the heatsink 180, PWB 185 and contacts 215 as shown in FIG. 5A.

Alternatively, cable 225 may be hardwired to a fixed contact (not shown) on an upper side of carriage 30 near fixed datum plate 130. Contacts 215 of connector 210 which extend to the underside of sliding connector plate 120 can intimately contact the fixed contacts when the latch 190 is in the closed position, to electrically interconnect the printer 10 with the PWB 185 and the cartridge 90. However, since contacts 215 are movable with sliding connector plate 120, the interconnection is broken when the latch 190 is opened and the sliding connector plate 120 moves away from the fixed datum plate 130. This provides means for breaking electrical contact between the power supply and the printhead cartridge 90 during cartridge installation or removal.

The frictional force required to install the printhead cartridge 90 is also decreased because the contacts 215 do not have to be fully deflected during cartridge insertion. This deflection is accomplished by the latch 190 which is designed to have a mechanical cam. This eases the mechanical robustness requirements of the carriage scan rails 35 of the scan carriage 30.

While the present invention has been described with reference to specific embodiments, it is not confined to the specific details set forth, but is intended to cover such modifications or changes as may come within the scope of the following claims.

What is claimed is:

1. An ink jet printing system comprising:

a carriage which traverses across a printing area and a home area in a longitudinal direction along a length of at least one guide rail;

a sliding connector plate slidably affixed to said carriage for movement in the longitudinal direction relative to said carriage;

a printhead cartridge removably mounted on said sliding connector plate, said cartridge having a front face containing nozzles;

a maintenance station located in said home area;

a capping station located at said maintenance station, said capping station including a cap seal and being movable within said maintenance station in the longitudinal direction and normal to the longitudinal direction, between a cartridge install position and a capping position;

guide means for guiding said capping station between said cartridge install position and said capping position, said cap seal being in direct contact with said front face when in said capping position and said cap seal being spaced from said front face when said capping station is in said cartridge install position; and a latch located adjacent to said sliding connector plate for allowing sliding movement of said sliding connector plate when said latch is open and for retaining said sliding connector plate in fixed position on said carriage when said latch is closed.

2. The ink jet printing system of claim 1, wherein said guide means includes a camming ramp.

3. The ink jet printing system of claim 1, wherein said guide means includes a tang affixed to said capping station and protruding toward said carriage normal to the longitudinal direction, said tang being engageable by said sliding connector plate when said connector plate traverses from said printing area to said home area, for moving said capping station to said capping position by motion of said sliding connector plate.

4. The ink jet printing system of claim 1, wherein said latch is located to position said sliding connector plate in the longitudinal direction a distance relative to said carriage when said latch is moved between closed and open positions.

5. The ink jet printing system of claim 4, wherein said latch includes a cam mechanically coupled to said connector plate.

6. The ink jet printing apparatus of claim 4, wherein movement of said sliding connector plate provides means for allowing said capping station to move to said cartridge install position.

7. The ink jet printing system of claim 1, further comprising:

printer control means for controlling the printing system;

an electrical interconnection between said printer control means and said printhead cartridge; and means for disengaging said interconnection when said latch is opened, to remove said cartridge from a source of power.

8. The ink jet printing system of claim 7, wherein said interconnection includes electrical contacts located in said carriage and mating contacts on one side of said sliding connector plate, said mating contacts being electrically connected to said cartridge.

9. The ink jet printing system of claim 1, wherein said cap seal of said capping station is guided from said cartridge install position to said capping position in contact with said front face of said cartridge without relative contacting sliding motion between said cap seal and said front face.

10. An ink jet printing system comprising:

a carriage movable in a longitudinal direction across a printing area and a home area, said carriage including a horizontal surface and a vertical fixed datum plate;

a sliding connector plate located on said carriage for lateral movement along said horizontal surface toward and away from said fixed datum plate between an operative position and a cartridge install position, said sliding connector plate including a horizontal sliding portion and a vertical support portion, said vertical portion having a first opposing side and a second opposing side;

a printhead cartridge removably attached to said sliding connector plate on said first opposing side of said vertical support portion, said cartridge having a front face containing nozzles;

a heat sink loosely mounted on said second side of said vertical support portion; and aligning features located on said fixed datum plate and said heatsink for precisely aligning said sliding connector plate and said heatsink with said fixed datum plate.

11. The ink jet printing system of claim 10, further comprising:

a printed wiring board on a side of said heatsink facing said vertical support portion; and electrical contacts located on said second side of said vertical support portion for electrical engagement with said printed wiring board.

12. The ink jet printing system of claim 11, wherein said second side of said vertical support includes a standoff for providing a deflection stop for said heatsink as said heatsink is moved toward said fixed datum plate.

13. The ink jet printing apparatus of claim 12, wherein said standoff is located vertically near the midpoint of said vertical supporting portion.

14. The ink jet printing system of claim 11, further comprising second electrical contacts on said horizontal surface of said carriage, said second electrical contacts being electrically engageable with said electrical contacts on said vertical support portion, said electrical contacts on said vertical support portion and said second electrical contacts being movable with respect to each other, thereby breaking electrical contact between said electric contacts when said sliding connector plate is moved away from said fixed datum plate.

15. The ink jet printing system of claim 10, further comprising:

a maintenance station located in said home area;

a capping station located at said maintenance station, said capping station including a cap seal, said capping station being movable within said maintenance station in the longitudinal and normal thereto direction, said capping station being movable between a cartridge install position and a capping position;

guide means for guiding said capping station between said cartridge install position and said capping position; and engagement means cooperating between said capping station and said printhead carriage to position said capping station between said cartridge install position and said capping position.

16. A method of inserting a cartridge into a thermal ink jet printer, the ink jet printer including a scan carriage movable in a longitudinal direction, said carriage including a fixed datum plate a sliding connector plate relatively movable with respect to the scan carriage in a longitudinal direction, a printhead cartridge located on the sliding connector plate, and a latch located adjacent to said datum plate, the method comprising the steps of:

opening said latch to position the sliding connector plate from an operative printing position fixedly attached to the fixed datum plate of the scan carriage to a cartridge install position displaced a distance in the longitudinal direction from the fixed datum plate to allow insertion of the printhead cartridge; and closing said latch to position the sliding connector plate back in the operative printing position.

17. The ink jet printer method of claim 16, wherein the printing system further includes a capping station movable between a capping position, in intimate contact with a front face of the printhead cartridge, and an inoperative capping position, displaced away from the front face of the printhead to allow vertical cartridge insertion, the method further comprising the steps of:

positioning the capping station at the inoperative capping position during printing by the printhead cartridge;

positioning the capping station at the capping position during non-printing periods;

positioning the capping station at the inoperative capping position, which also serves as a cartridge install position, when the latch is opened; and positioning the capping station back to the capping position when the latch is again closed.

18. The ink jet printing system method of claim 16, further comprising the steps of:

providing a power electrical interconnection from a power supply of the printing system to a printed wiring board on the scan carriage when the latch is closed; and breaking power interconnection to the printed wiring board when the latch is opened.

* * * * *